US005839286A

United States Patent [19]

Lee

[11] Patent Number: 5,839,286

[45] Date of Patent: Nov. 24, 1998

[54] METHOD FOR PROTECTING AN ICE MAKER FROM OPERATION FAILURE

[75] Inventor: Kun-bin Lee, Seoul, Rep. of Korea

[73] Assignee: Samsung Electronics Co., Ltd., Suwon, Rep. of Korea

[21] Appl. No.: 872,395

[22] Filed: Jun. 10, 1997

[30] Foreign Application Priority Data

Jun. 10, 1996 [KR] Rep. of Korea ..... 1996-20575

[51] Int. Cl.[6] ..... F25C 1/12

[52] U.S. Cl. ..... 62/72; 62/233

[58] Field of Search ..... 62/72, 137, 233, 62/353

[56] References Cited

U.S. PATENT DOCUMENTS

| | | | |
|---|---|---|---|
| 5,163,300 | 11/1992 | Kato et al. | 62/233 |
| 5,477,694 | 12/1995 | Black et al. | 62/137 |
| 5,675,975 | 10/1997 | Lee | 62/72 |
| 5,697,222 | 12/1997 | Lee | 62/233 |

*Primary Examiner*—William E. Tapolcai
*Attorney, Agent, or Firm*—Burns, Doane, Swecker & Mathis, L.L.P.

[57] ABSTRACT

An ice making mechanism includes a tray for receiving water to be frozen into ice bodies, a sensor for determining whether the water is frozen, to initiate an ice-ejecting mode, a motor for rotating the tray to perform the ice-ejecting mode, a switching mechanism for indicating a state of the ice-ejecting mode, and a switch actuating structure driven by the motor for changing a state of the switches during the ice-ejecting mode. A state of the switching mechanism is detected in response to the supplying of electrical power to the ice making mechanism, to determine whether the tray is in an initial upright position. If it is determined that the tray is not in the initial upright position, an ice-ejecting mode is initiated. A time period is counted beginning from the initiation of the ice-ejecting mode, and the state of the switching mechanism is monitored to determine whether and when that state changes. The ice-ejecting mode is stopped when the state of the switching mechanism has not changed within a reference time period.

8 Claims, 5 Drawing Sheets

METHOD FOR PROTECTING AN ICE MAKER FROM OPERATION FAILURE

RELATED INVENTION

This invention is related to that disclosed in concurrently filed U.S. Ser. No. 08/872,064.

BACKGROUND OF THE INVENTION

1. Field of the Invention

The present invention relates to a method for protecting an ice maker from operation failure.

2. Description of the Related Art

Usually, an ice maker is disposed within a freezing chamber of a refrigerator. Such an ice maker includes a tray automatically supplied with water to be frozen to form ice bodies. The maker automatically checks the freezing condition of the water in the tray. Upon completion of freezing the ice bodies, the ice maker ejects the ice bodies from the tray to an ice collecting bin. Such convenience makes the ice maker a necessary component of a refrigerator.

The conventional ice-maker operates with several function units, which are shown in FIG. 1. According to the drawing, there is a power supply 1 for supplying the ice maker with drive voltage. A first sensing means 2 is for sensing the position of the tray. A function selector 3 includes a plurality of function keys for allowing a user to choose an automatic ice-making function. A first rotation controller 5 controls the rotation of an ice-ejecting motor 4 which operates to eject ice bodies. A second rotation controller 7 controls rotation of a water supply motor 6 for supplying the tray with water. A second sensing means 8 mounted on the bottom of the tray checks the ice-ejecting status. A motor protector 9 prevents the motor 4 from overload. Finally, a microcomputer 10 governs all of the above components.

The structure of the ice-maker is illustrated in FIG. 2A through FIG. 2C. Referring to FIG. 2A, the ice maker includes a housing 11. An ice-ejecting motor 4 and a worm gear 12 fixed on a shaft extending from the motor 4 are enclosed in the housing 11. Also enclosed are a first gear 13, a second gear 14 and a third gear 15 which are in mesh successively from the worm gear 12 to the third gear 15, whereby the rotary power of the worm gear 12 is transmitted to the third gear 15 successively. A cam gear 16 is meshed with the third gear 15 and rotated thereby.

A lug 18 is formed by a radial extension of the cam gear 16 at a fixed position of the circumference thereof and protects a tray 17 from excessive rotation beyond a normal upright state which may cause damage to the tray 17. In the housing is arranged a first stopper 19 to come in contact with the lug 18 to obstruct counter-clockwise rotation of the cam gear 16 when the tray 17 has returned to the horizontal upright state.

When the tray 17 rotates approximately 158° clockwise from the FIG. 2A position, the lug 18 comes in contact with a second stopper 20 fixed on the motor 4 to prevent the cam gear 16 from rotating further clockwise.

A horizontal switch 21 for showing the horizontal status of the tray 17 is furnished under the cam gear 16. The horizontal switch 21 is controlled by a horizontal adjusting cam 22 installed on the cam gear 16.

A level switch 23 is located adjacent to the horizontal switch 21. When an arm connector 25 is pushed by an arm adjusting cam 24 installed on the cam gear 16, a level arm 26 fixed to the arm connector 25 pivots to turn the level switch 23 on. At this time, the pivotal rotation of the level arm 26 is controlled by a quantity of the ice bodies in the ice collecting bin (not shown).

Referring to FIG. 2C, a sensor 27 (e.g. a thermistor) is mounted on the bottom of the tray 17. It senses the temperature of the tray 17 and determines the condition of the ice bodies in the tray 17, i.e. whether the ice bodies have been completely frozen or not, and whether the ice bodies have been removed from the tray 17. The sensor 27 is included in the second sensing means 8 of FIG. 1. According to the temperature change sensed by the sensor 27, the second sensing means 8 checks a change in voltage to determine the status of the ice bodies.

The operation of the conventional ice maker will be described with reference to FIGS. 3A to 3D.

When a user selects a key out of the plurality of function keys of the function selector 3 for an automatic ice making process, the microcomputer 10 recognizes the manipulation. Simultaneously, voltage from the power supply 1 is provided to the microcomputer 10 and all the other components of FIG. 1.

The microcomputer 10 then receives control signals from the function selector 3 and outputs corresponding control signals. Afterwards, the control signals are transmitted to the second rotation controller 7 to activate the water supply motor 6. As a result, a preselected amount of water is supplied to the tray 17 via a delivery tube (not shown) from a suitable water source disposed in a fresh food chamber (not shown). At this time, the tray 17 is in the initial upright state as shown in FIG. 3A. The horizontal switch 21 is in contact with a recessed part of 22B of the horizontal adjusting cam 22. Therefore, the horizontal switch 21 maintains an off-state. The arm connector 25 is not pressed by the arm adjusting cam 24. Accordingly, the level arm 26 does not rotate. The level switch 23 also maintains an off-state. As described above, when both of the horizontal switch 21 and the level switch 23 are in an off-state, the microcomputer 10 determines that the tray 17 is in an initial state.

The microcomputer 10 checks a freezing condition of the water in the tray 17 by the second sensing means 8. Upon completion of freezing, the microcomputer 10 transmits a control signal to the first rotation controller 5 to rotate the motor 4 in a direction (e.g. clockwise direction as illustrated here). This is shown in FIG. 3B. The horizontal adjusting cam 22 accordingly rotates. After a few degrees of rotation, the horizontal switch 21 comes in contact with a round (non-recessed) part of the horizontal adjusting cam 22. As a result, the state of the horizontal switch 21 is converted into an on-state. Furthermore, the arm connector 25 is in contact with the round part of the arm adjusting cam 24. At this time, the arm connector is pressed and the level arm 26 rotates. Consequently, the level switch 23 is also converted into an on-state. When the horizontal switch 21 and the level switch 23 are in their on-state, the microcomputer 10 determines that the ice maker is in an ice-ejecting preparation state.

The horizontal adjusting cam 22 further rotates during the rotation of the motor 4. As a result, the horizontal switch 21 comes in contact with the other curved recessed part 22A of the horizontal adjusting cam 22. At this time, the horizontal switch 21 returns to an off-state. However, the arm connector 25 is still in contact with the round part of the arm adjusting cam 24. In other words, arm connector is still pressed by the round part of the cam 24 so that the level switch 23 maintains the on-state, which is shown in FIG. 3C. This state is indicated to the microcomputer 10. Then, the microcomputer 10 determines that the ice maker is in an ice-ejecting state, followed by controlling the first rotation controller 5 to suspend the operation of the motor 4. When the open side of the tray 17 faces the ice collecting bin before the rotation of the tray 17 has completely stopped, one end (i.e. the end opposite to the motor 4) of the rotating shaft installed at the bottom of the tray 17 is caught on a projection (not shown), while the other end (i.e. the end connected to the motor 4) of the rotating shaft continues to be rotated by the motor 4. Accordingly, the tray is twisted to eject the ice bodies.

The second sensing means 8 sends a control signal when it determines that the ice bodies have been completely ejected from the tray 17. As a result, the microcomputer 10 controls the first rotation controller 5 to make the motor 4 rotate in a counter-direction (counter-clockwise direction as illustrated here). Then, the horizontal switch 21 comes in contact with the round part of the horizontal adjusting cam 22 and is converted into an on-state. The arm connector is still in contact with the round part of the arm adjusting cam 24 so that the level switch 23 still maintains an on-state. At this time, the microcomputer 10 senses that both the horizontal switch 21 and the level switch 23 are in an on-state. Consequently it determines that the ice maker is in a return preparation state.

Afterwards, due to continuing rotation of the motor 4, the horizontal switch 21 comes in contact with the curved recessed part of the horizontal adjusting cam 22 and the arm connector 25 is released from the pressure of the arm adjusting cam 24 as shown in FIG. 3D. Thus, both the horizontal switch 21 and the level switch 23 are converted into an off-state. The microcomputer 10 senses that the horizontal switch 21 and the level switch 23 are turned off and determines that the ice maker has returned to the initial state. As a result, the microcomputer 10 controls the first rotation controller 5 in order to suspend the rotation of the motor 4.

As described above, the ice ejecting mode includes several states, i.e. the initial state, the ice-ejecting preparation state, the ice-ejecting state, the return preparation state and the return state, which may be repeated as required.

The motor protector 9 detects voltage supplied to the motor 4. In order to protect the motor 4 from damage or troubles caused by overload, the rotation of the motor 4 stops in the presence of excessive voltage supply.

However, if the electric supply is suspended while the ice maker is in the ice ejecting mode or returns its operation mode to the initial state, the motor 4 stops and the tray 17 cannot completely return to the horizontal upright state. If power is supplied again under such a condition, the microcomputer 10 is reset and assumes that they tray 17 has completely returned to the initial state and tries to commence a normal ice making process. This causes operation failure.

Furthermore, since the microcomputer 10 determines the status of the tray 17 according to the states of the level switch 23 and the horizontal switch 21 as described above there may be another problem when the power is resumed with the switch 23 in an on-state (due to the ice collecting bin being full), because the microcomputer 10 may mistakenly determine that the tray 17 is not in the initial state though it is substantially in the initial state.

SUMMARY OF THE INVENTION

It is therefore an object of the present invention to provide a method for protecting an ice maker from operation failure.

To achieve the above and other objects of the invention it is determined whether or not the tray is in an initial upright state when power is either initially supplied, or resumed after a suspension, and performing an ice-ejecting mode if it is determined that the tray is not in the initial upright state. The ice ejecting mode is stopped if the ice maker is determined as not operatign normally, and preferably is returned to the initial state.

In particular, the method relates to controlling an ice making mechanism which includes a tray positionable in an initial upright state for receiving water to be frozen into ice bodies. A sensor determines whether the water is frozen in order to initiate an ice-ejecting mode. A motor rotates the tray to perform the ice-ejecting mode. A switching mechanism indicates a state of the ice-ejecting mode, and a switch-actuating structure driven by the motor for changing a state of the switching mechanism during the ice-ejecting mode. The method comprises the steps of:

A) detecting a state of the switching mechanism in response to the supplying of electrical power to the ice making mechanism, to determine whether the tray is in an initial upright position;

B) initiating an ice-ejecting mode if it is determined in step A that the tray is not in the initial upright state;

C) counting a time period beginning from step B;

D) determining whether the state of the switching mechanism has been changed; and E) stopping ice-ejecting mode when a state of the switching mechanism has not changed within a reference time period.

Preferably, step D further includes returning the tray to the initial upright state.

Step E preferably comprises sensing a change of state of the switching mechanism, determining the time period when such a change of state occurs, and comparing the time period with a reference time period.

The switching mechanism preferably comprises first and second separately actuable switches. Step D preferably comprises determining a first time period beginning from step B when both switches are changed from an off-state of an inactive condition to an on-state of a final ice-ejecting preparation condition, and comparing the first time period with a first reference time period.

Step D further comprises determining a second time period beginning from step B, when the first switch is changed from the on-state of the final ice-ejecting preparation condition to an off-state of an ice-ejecting condition, and comparing the second time period with a second reference time period.

Step D further comprises determining a third time period beginning from step B, when the first switch is changed from the off-state of the inactive condition to an on-state of an initial ice-ejecting preparation state with the second state still in an off-state, and comparing the third time period with a third reference time period.

BRIEF DESCRIPTION OF THE DRAWINGS

The objects and advantages of the invention will become apparent from the following detailed description of preferred embodiments thereof in connection with the accompanying drawing in which like numerals designate like elements and in which.

DETAILED DESCRIPTION OF A PREFERRED EMBODIMENT OF THE INVENTION

The following is a preferred embodiment according to the invention. For description purposes, elements having basically the same function as the previously described conventional elements are identified using common reference numbers throughout the drawings, and detailed descriptions thereof are omitted below.

Figure 1:
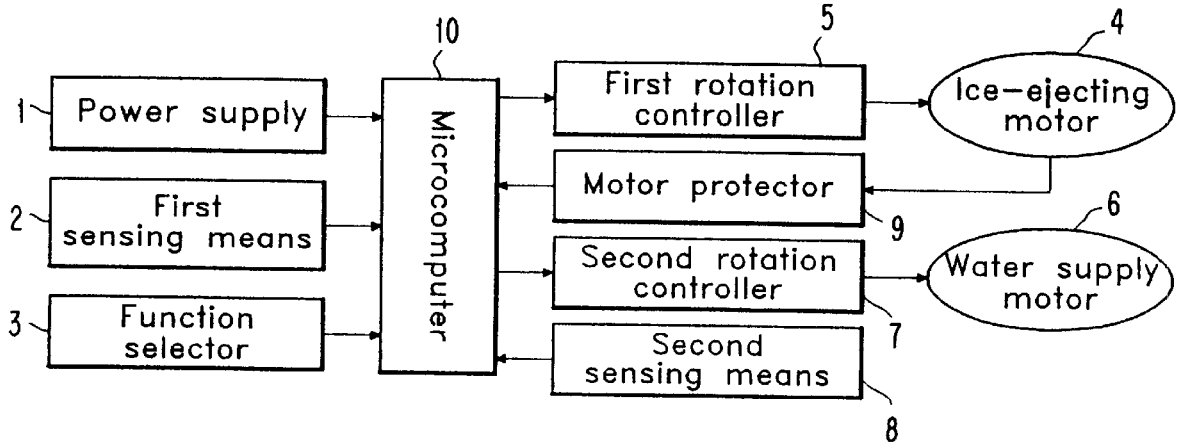
Fig. 1 (PRIOR ART)
FIG. 1 is a schematic block diagram of a conventional ice-maker.
Figure 2A:
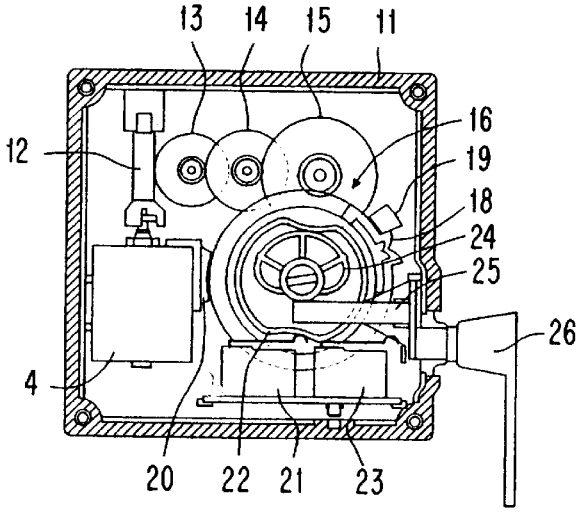
Fig. 2A (PRIOR ART)
FIGS. 2A to 2C are perspective views of the conventional ice maker.
Figure 2B:
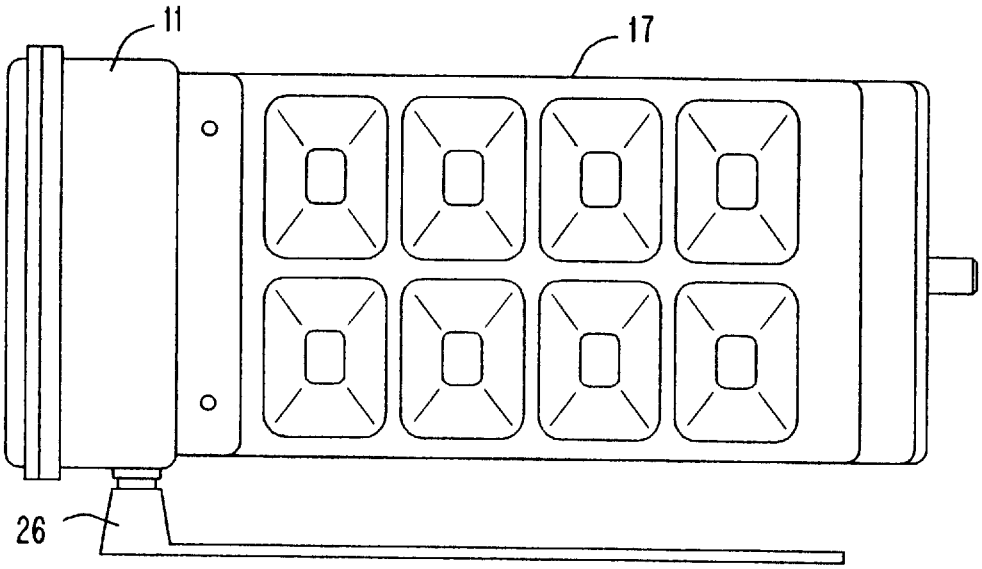
Fig. 2B (PRIOR ART)
Figure 2C:
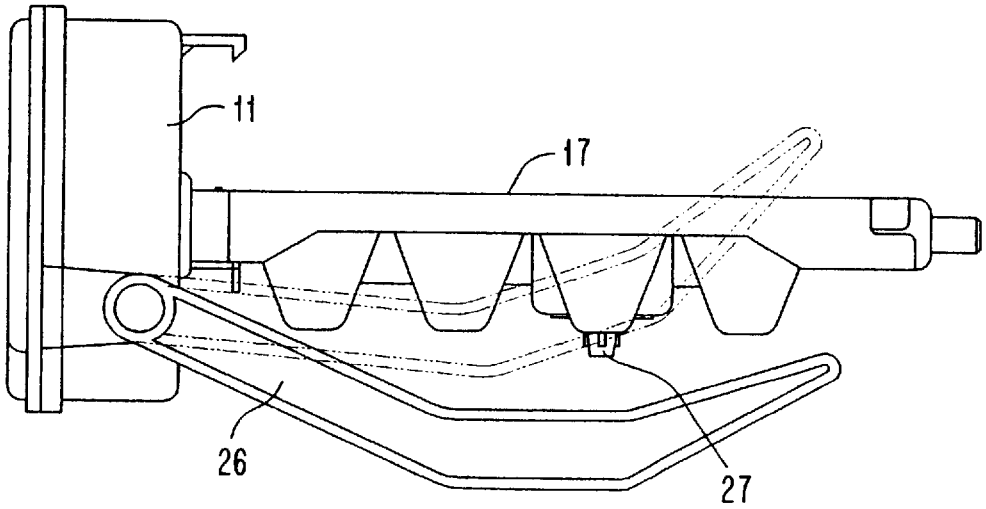
Fig. 2C (PRIOR ART)
Figure 3A:
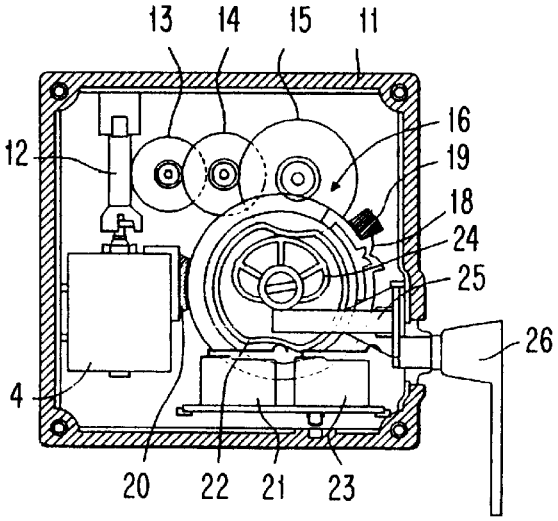
Fig. 3A (PRIOR ART)
FIG. 3A to 3D are perspective views for explaining the operation of the conventional ice maker.
Figure 3B:
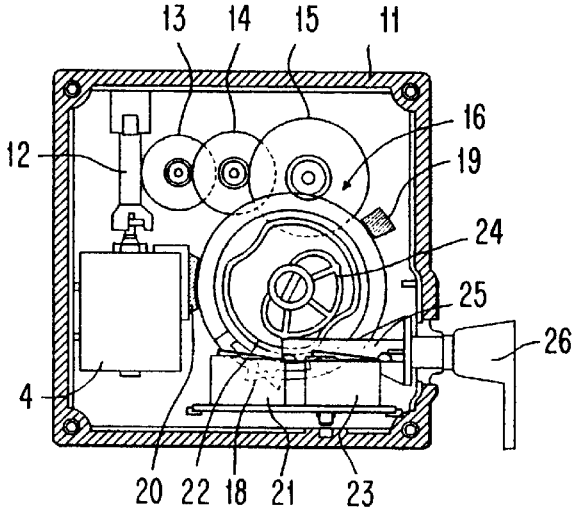
Fig. 3B (PRIOR ART)
Figure 3C:
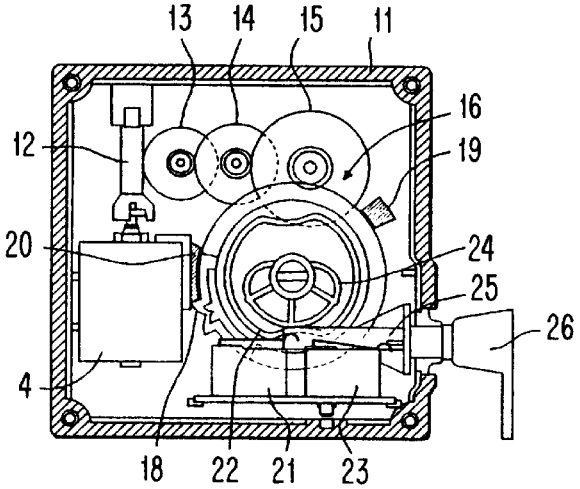
Fig. 3C (PRIOR ART)
Figure 3D:
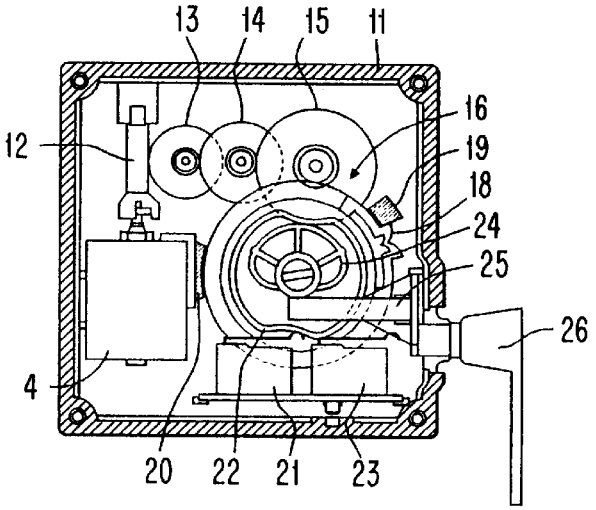
Fig. 3D (PRIOR ART)
Figure 4:
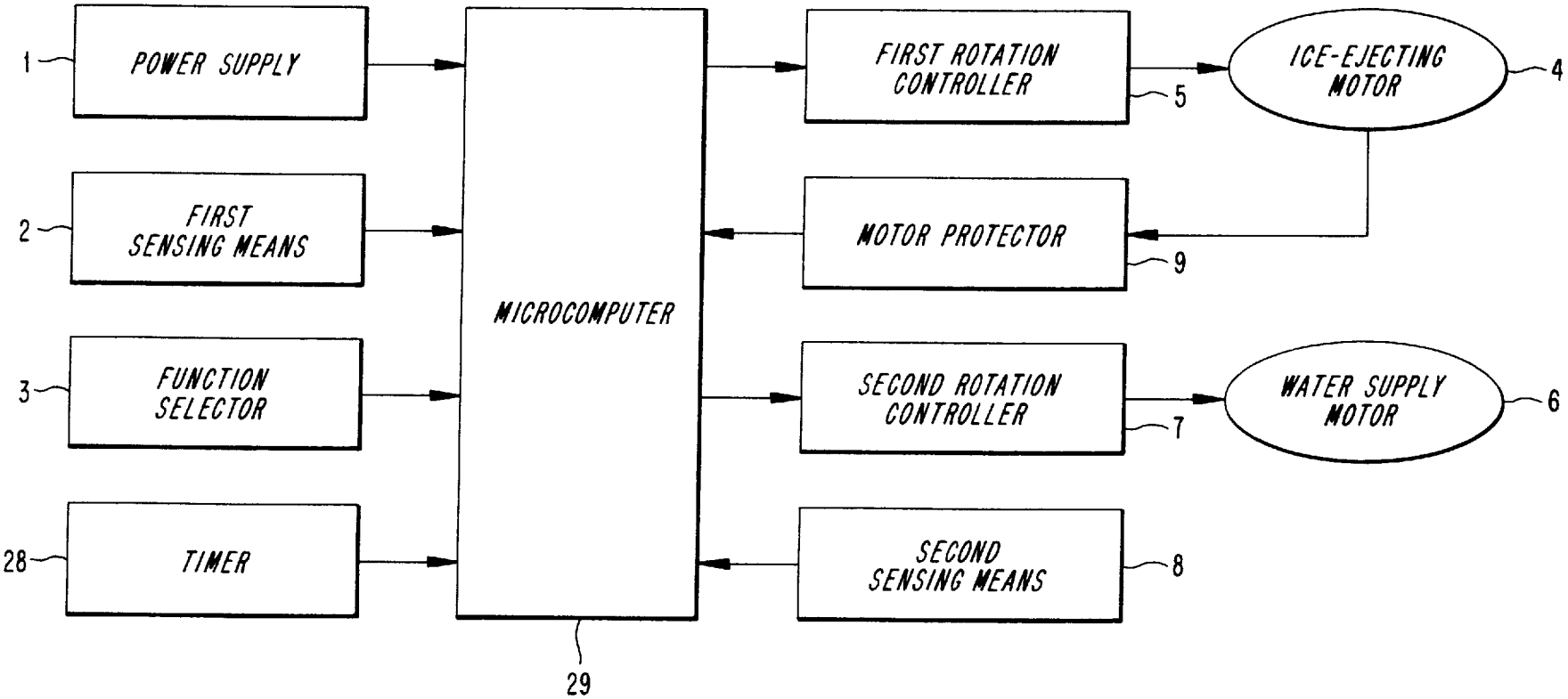
FIG. 4 is a schematic block diagram of an ice maker according to the invention.

Referring to FIG. 4, the invention includes: a first sensing means 2 for sensing the position of the tray, which sensing means is composed of the horizontal switch 21 and the level switch 23; a timer 28 for counting time and outputting time information; an alarming means 29 for indicating the occurrence of trouble in the ice maker; and a microcomputer 30 in which reference times according to the states of the horizontal switch and the level switch are predesignated, for controlling all the other components of the ice maker by comparing the time information with the predesignated reference time. The sensor 2, timer 28, alarm 29, and microcomputer would be associated with an ice maker of the type depicted FIGS. 3A–3D.

Figure 5:
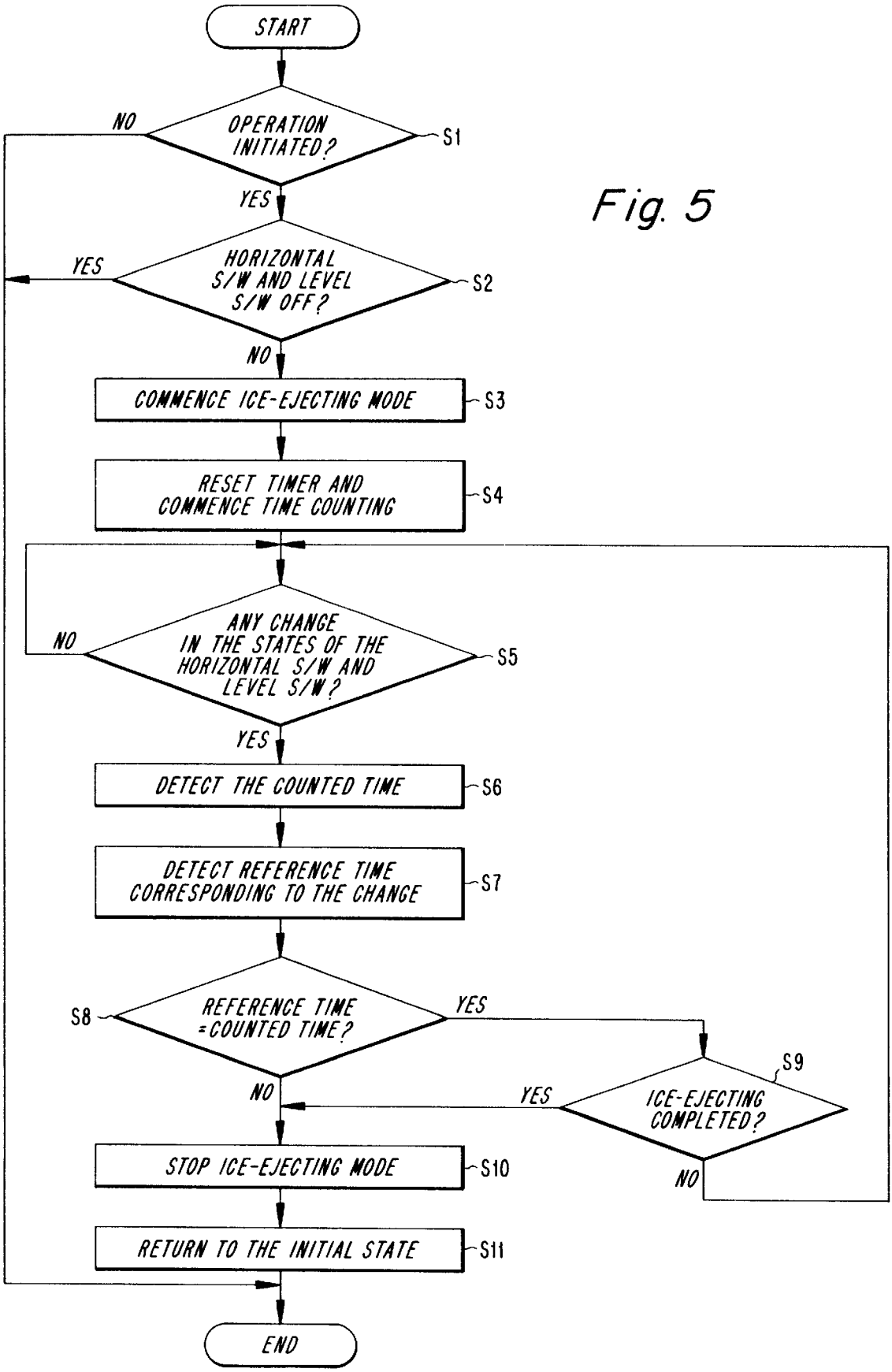
FIG. 5 is a flow chart for explaining the operation of the microcomputer of FIG. 4.

Referring to FIG. 5, the operation of the invention will be described.

With reference to FIG. 5, the operation of the invention will be described. Starting at step S1, the microcomputer 29 determines whether or not the ice maker initiates operation. When power is supplied again after a suspension, or when the ice maker initiates an automatic ice making operation in response to a command of a user, the microcomputer 29 resets its mode for the initial operation. If the microcomputer determines the ice maker is not in the initial operation mode at step S1, this means that the ice maker is operating normally, or the automatic ice making function has not been selected by a user. Accordingly, the microcomputer 29 terminates the whole process.

Otherwise, if the microcomputer determines that the ice maker is in the initial operation mode at step S1, this means either that power to the ice maker has been resumed after a suspension thereof, or that a user has just selected an automatic ice making function. The microcomputer 29 then determines whether or not the horizontal switch 21 and the level switch 23 are in their off-state at step S2. When both of the switches 21 and 23 are in the off-state, it means that the tray 17 is in the initial upright state. As a result, the microcomputer 29 determines the ice maker is operating normally, and terminates the whole process.

If the microcomputer 29 determines that the horizontal switch 21 and the level switch 23 are not in the off-state, this means either that the tray 17 is not in the horizontal upright state, or that the level switch 23 has been moved to its on-state due to the ice collecting bin being full. Under this condition, the microcomputer 29 controls the first rotation controller 5 to set the ice maker in the ice-ejecting mode at step S3 and simultaneously resets the timer 28 to commence a time counting at step S4.

Then at step S5, a determination is made as to whether or not the states of the horizontal switch 21 and the level switch 23 have changed. If the determination is negative, this shows the ice maker is still in the same condition. In other words there is no change in state of the ice maker, e.g. from the initial state to the ice-ejecting preparation state, or from the ice-ejecting preparation state to the ice-ejecting state and vice-versa. At this time, the microcomputer 30 repeats step S5 until a state change occurs in the two switches 21 and 23.

Otherwise, if the answer is positive at the determination at step S5, this shows that the state of the ice maker is changed to another state. Then, the microcomputer 30 detects the time counted by the timer 28 at step S6, and simultaneously detects reference time information pertinent to a change in the state of the switches 21 and 23 at step S7. Table 1 shows the reference times.

Table 1 shows the reference times:

TABLE 1

| Rotation of Ice-ejecting motor | Horizontal switch | Level switch | Time (sec) | State of ice-ejecting mode |
|---|---|---|---|---|
| Start | Off | Off | 0 | Initial state (inactive) |
| Clockwise | On | Off | 1.2 | Initial ice-ejecting preparation state |
| | On | On | 2.6 | Final ice-ejecting preparation state |
| | Off | On | 8.0 | Ice-ejecting state |
| Stop | | | 1 sec wait | |
| Counter-Clockwise | On | On | 1.2 | Return preparation state |
| | On | Off | 6.8 | |
| Stop | Off | Off | 8.0 | Initial state |

Steps S6 and S7 are followed by step S8 in which the microcomputer 30 compares the counted time obtained at step S6 with the reference time obtained at step S7. If the counted time corresponds to the reference time, it shows that the ice maker is operating normally.

Then at step 9, the microcomputer 29 determines whether or not the ice-ejecting operation has been completed. If it is determined that the ice-ejecting operation has not been completed at step S9, the microcomputer 29 returns the process to step S5 to repeat the steps subsequent thereto.

Otherwise, if it is determined that the reference time is different from the counted time at step 8, this shows that the ice maker is operating abnormally or that the level switch 23 maintains an on-state due to the ice collecting bin being full. Under such a condition, the microcomputer 29 controls the first rotation controller 5 to suspend the operation of the ice-ejecting motor 4. As a result, the ice maker stops the ice-ejecting function at step S10. Afterwards, the microcomputer 29 controls the first rotation controller 5 to rotate the motor 4 in the counter-direction (counter-clockwise direction) and accordingly the tray 17 returns to the initial state at step S11. This ends the process for protecting the ice maker due to abnormal operation. Therefore, the ice-ejecting mode stops and the tray 17 returns to the initial state in the event the tray 17 is not in the initial state when the ice maker initially operates.

If it is determined that the ice-ejecting operation has completed at step S9, the microcomputer 29 performs steps S10 and S11. Therefore, if the tray is in the initial state when the ice maker initiates its operation, automatically the ice-ejecting operation is performed and the tray 17 returns to the initial state.

As described above, the method according to the invention has the advantageous effect of protecting an ice maker from operation failure by performing an ice-ejecting function when electric supply is resumed after having been suspended during the ice-ejecting state or the return state. The ice maker counts the time required for the horizontal switch and the level switch to change their states and compares the counted time with the reference time predesignated in the microcomputer. The ice maker selectively operates to perform the ice-ejecting function or the tray returning function according to the result of the comparison.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A method of controlling an ice making mechanism which includes a tray position for receiving water to be frozen into ice bodies, a sensor for determining whether the water is frozen and to initiate an ice-ejecting mode, a motor for rotating the tray to perform the ice-ejecting mode, a switching mechanism for indicating a state of the ice-ejecting mode, and a switch-actuating structure driven by the motor for changing a state of the switching mechanism during the ice-ejecting mode, the method comprising the steps of:

A) detecting a state of the switching mechanism in response to the supplying of electrical power to the ice making mechanism, to determine whether the tray is in an initial upright position;

B) initiating an ice ejecting mode if it is determined in step A that the tray is not in the initial upright position;

C) counting a time period beginning from step B;

D) determining whether the state of the switching mechanism has been changed; and E) stopping the ice-ejecting mode when a state of the switching mechanism has not changed within a reference time period.

2. The method according to claim 1 wherein step D further includes returning the tray to the initial upright state.

3. The method according to claim 1 wherein step E comprises sensing a change of state of the switching mechanism, determining the time period when such a change of state occurs, and comparing the time period with a reference time period.

4. The method according to claim 3 wherein the switching mechanism comprises first and second separately actuable switches, step D comprising determining a first time period beginning from step B, when both switches are changed from an off-state of an inactive condition to an on-state of a final ice-ejecting preparation condition and comparing the first time period with a first reference time period.

5. The method according to claim 4 wherein step D further comprises determining a second time period beginning from step B, when the first switch is changed from the on-state of the final ice-ejecting preparation condition to an off-state of an ice-ejecting condition, and comparing the second time period with a second reference time period.

6. The method according to claim 5 wherein step D further comprises determining a third time period beginning from step B, when the first switch is changed from the off state of the inactive condition to an on state of an initial ice-ejecting preparation state with the second switch still in an off-state, and comparing the third time period with a third reference time period.

7. The method according to claim 5 wherein the ice-ejecting mode is performed to completion when the second time period corresponds to the second reference time period.

8. The method according to claim 1 wherein the switching mechanism comprises first and second separately actuable switches, the tray determined as being in an initial upright state in step A when both of the switches are off.

* * * * *